US007300040B2

(12) United States Patent
Thomas

(10) Patent No.: US 7,300,040 B2
(45) Date of Patent: Nov. 27, 2007

(54) SIMPLE, MECHANISM-FREE DEVICE, AND METHOD TO PRODUCE VORTEX RING BUBBLES IN LIQUIDS

(76) Inventor: Andrew Sydney Withiel Thomas, 1703 Barleton Way, Houston, TX (US) 77058

( * ) Notice: Subject to any disclaimer, the term of this patent is extended or adjusted under 35 U.S.C. 154(b) by 111 days.

(21) Appl. No.: 11/019,470

(22) Filed: Dec. 23, 2004

(65) Prior Publication Data

US 2006/0145366 A1 Jul. 6, 2006

(51) Int. Cl.
*B01F 3/04* (2006.01)

(52) U.S. Cl. ..... 261/79.2; 261/123

(58) Field of Classification Search ..... 261/79.2, 261/123, 121.1

See application file for complete search history.

(56) References Cited

U.S. PATENT DOCUMENTS 2,150,614 A * 3/1939 Sutkowski ..... 261/123
4,005,014 A * 1/1977 Wikey ..... 210/192
4,534,914 A * 8/1985 Takahashi et al. ..... 261/64.3
5,947,784 A * 9/1999 Cullen ..... 446/15
2002/0074673 A1* 6/2002 Whiteis ..... 261/62
2004/0088894 A1* 5/2004 Haughton et al. ..... 40/406

* cited by examiner

*Primary Examiner*—Scott Bushey

(57) ABSTRACT

An apparatus and method are described that allows for the production of vortex-ring bubbles in a liquid. The device is an inverted cup with a short nozzle protruding through the center of its end face such that the nozzle lower opening is at a higher level than the open end of the inverted cup. When the immersed cup is pressurized with an inflow of gas, the liquid level of the confined gas in the cup will fall, and peel away from the nozzle open end. The gas will enter the nozzle when the pressure has built up within the cup sufficiently to break the liquid surface tension at the nozzle opening. The gas then self accelerates up through the nozzle and self organizes into a gas-filled vortex ring at the nozzle exit. The liquid level in the cup rises back up and re-enters the nozzle in a unique self-siphoning action shutting off further gas flow out the nozzle. Alternatively, the exiting flow of gas can be captured in a second conical nozzle and buoyantly directed to the throat of a cone where it undergoes the same self acceleration and self siphoning to form a vortex ring at the throat exit. Other embodiments of the device are described. The advantages are that the device is mechanically simple, easy to manufacture, has no moving pans, will not wear out, and does not require any operator intervention in order to function.

9 Claims, 10 Drawing Sheets

SIMPLE, MECHANISM-FREE DEVICE, AND METHOD TO PRODUCE VORTEX RING BUBBLES IN LIQUIDS

BACKGROUND OF THE INVENTION

1. Technical Field

This invention describes a simple apparatus and method for producing vortex ring bubbles of a gas in a host liquid. Once provided with a source of compressed gas, the basic geometry of the device establishes the conditions such that it will repetitively and endlessly produce gas-filled, vortex ring bubbles in a host liquid, at a rate determined only by the pressure and in-flow rate of the gas source. The device requires no high-tolerance components and is low-cost to manufacture. It has no moving parts, and will not wear out. It requires no periodic maintenance servicing, no human intervention, and no fine adjustments to sustain its operation.

2. Description of the Prior Art

Some forty years ago it was first reported that it is possible to generate rising toroidal ring-shaped bubbles, or ring bubbles as they are sometimes called, of gas within liquids. These are in fact vortex rings in the liquid, in which the gas collects in the ring-shaped core of the vortex and is thereby made visible as a circular tube of gas. In recent years it has become appreciated that these rings are a natural phenomenon that are even produced by whales and dolphins, evidently simply for amusement. Those creatures have sometimes been observed to create a vortex ring from their flippers, into which they exhale a bubble of air that is then drawn into the core of the ring to create the ring bubble. More often however, they create rings by rapidly exhaling a short upwards pulse of air which then evolves into the ring. Skilled professional divers have also been known to produce them by the analogous means of carefully exhaling a short pulse of air upwards into the surrounding water medium. Some experience on the part of the diver is necessary, but with practice quite impressive rings can be created, and these can travel upwards for large distances before breaking up. The skill required lies in being able to properly control the characteristics of the exhaled pulse of air so that rings will form, as opposed to the more familiar chaotic plumes of bubbles. If the right conditions are established, smooth circular rings will evolve. The ease with which this can be done follows from a mechanism of self organization or self stabilization, in which the swirl, or fluid dynamic circulation about the core of the gas ring stabilizes the entire ring so that it quickly develops into a smooth symmetric shape. Self stabilization and self organization of vortex rings is a common natural phenomenon that can be seen in smoke rings in which the self-induced motion quickly organizes even a distorted shape into a smooth circular ring. For the case of the ring bubble, the process leads to a ring that defies intuition by not collapsing into a chaotic plume of bubbles.

In fact it has sometimes been argued that these gas-filled toroidal bubbles are analogous to the familiar smoke rings in air. However, they are more complex as two distinct fluid phases are involved, namely the liquid medium, and the tubular core of gas. It has been known for over a hundred years that a tube of gas in a liquid should spontaneously collapse and break up through the effect of surface tension instability. That this does not happen for the toroidal tube of the ring bubble can be attributed to the stabilizing influence of the fluid dynamic circulation around the tubular core. In physical terms, the centrifugal force of the liquid spinning around the core opposes and balances the collapsing force of the surface tension (the same mechanism stabilizes the more familiar bath tub vortex).

In fluid dynamic terms, the surface tension pressure directed inwards on the gas at the gas/liquid interface of the core, is given by $\Delta P=\sigma/R$, where $\sigma$ is the coefficient of surface tension of the liquid and R is the radius of the core of the vortex. The magnitude of the outward pressure arising from the centrifugal force can be determined from an analysis of the forces on a small element of liquid at the interface and can be shown to be $2\rho R^2\omega^2$, where $\rho$ is the liquid density and $\omega$ is the angular spin velocity of the gas/liquid interface. For a stable ring bubble, these two components of force should be equal.

This condition will exist on the inside surface of the core of the ring bubble vortex and shows that a bubble ring is only possible if the right volume of gas is issued and if the right circulation is imparted to it so that the conditions are maintained. In addition, it can be seen that a small thin core will rotate relatively quickly to preserve stability, while a thicker core must turn more slowly.

For the rising vortex ring bubble, there is also an upward buoyancy force present, but that is balanced by a downward cross-flow force arising from the lateral spread of the spinning core of the ring, analogous to the lateral force on a spinning ball. Thus, the ring, once formed, will steadily rise and spread out and thin. If the ring rises a large distance, then the local static pressure falls in relation to the internal pressure within the ring, so that there will be a countering tendency that slows down the thinning of the ring. However, eventually a point is reached where viscosity dampens the energy of the circulation so that surface tension then dominates leading to breakup of the ring. Despite this, very long lived rings can be created before breakup occurs.

Various U.S. patents document methods of producing vortex rings of different co-mingled liquids and gasses. U.S. Pat. No. 3,589,603 by Fohl allows two different fluids to come together in a co-annular nozzle and mix to form a vortex ring. The fluid motions are generated by two moving pistons, but the device does not consider the case of one fluid being a liquid and the other being a gas as would be needed for forming a gas-filled ring bubble. The inventor gives no evidence that the device could produce toroidal ring bubbles.

U.S. Pat. No. 5,100,242 by Latto uses a technique in which a moving orifice plate generates a ring vortex that can be used to enhance fluid mixing. The inventor claims it can be used in water to produce aerated rings through seeding of the vortex flow with bubbles, but this is not the same as producing ring bubbles which are single, coherent self-organized structures. These coherent structures require very specialized conditions of pulse flow and pulse duration if they are to form.

There are also a number of U.S. patents that describe different methods of creating gas-filled rings by generating the required pulsed flow of gas in some way. For example, U.S. Pat. No. 4,534,914 to Takahashi et al. describes a device that uses an accumulator with a diaphragm in one wall that unseats a spring loaded valve when under pressure allowing gas to flow out into a nozzle. The nozzle has a second elastic valve at its exit which is driven open by the pressure it is exposed to following the opening of the spring valve. As the flow exits through the two valves, the pressure in the accumulator falls, both valves close, creating a short duration pulse of gas. If the mechanical parameters of the device are chosen properly, a gas-filled vortex ring forms at the tip of the elastic valve. In a further embodiment, they replace the spring loaded valve with a pressure sensitive switch on the diaphragm to open the flow from the accumulator to the elastic valve, once a predefined pressure is reached. In a third embodiment, they use a timed pulse to a solenoid-actuated valve to feed the accumulator so that the rising pressure in the accumulator opens the second elastic valve creating the flow. Thus while operator skill or human intervention is not required to produce ring bubbles, proper tuning and setting of the valve parameters is required. If the valves leak, or jam, of fail in some other way, the operation of the device will be compromised.

In another example, in U.S. Pat. No. 5,947,784 to Cullen, a very similar device is described. In one embodiment it uses a small spring loaded annular nozzle at the end of a tube into which an operator blows to unseat the valve momentarily and create the ring. This device attempts to minimize the operator skill that is needed to generate rings. However, the operator effectively acts as a second valve that determines the strength and duration of the pulse that creates the vortex ring, so that some skill and human intervention is needed.

In a second embodiment, the pulse is created by an electrically driven pump actuated by a timed circuit. This is very similar to the third embodiment of Takahashi et al. As before, the pressure at which the vortex forms is a consequence of the resilience of the valves, and the duration of the pulse is also determined by this pressure and the volume of the tubing feeding the valve. Failure or jamming of the valve will compromise the operation of the device.

The method described by Whiteis, U.S. Pat. No. 6,488,270, is somewhat different and allows gas to flow from a pressurized source and to build up in a contained pocket under a plate. This plate tilts around a pivot in response to the buoyancy of the gas buildup. This directs the gas to a nozzle and allows it to momentarily escape into the surrounding liquid. The weight of the plate terminates the flow once a certain volume of gas has been expended. Therefore, although the device does not have a valve in the usual sense, the tilting plate clearly acts as a valve to create the required momentary flow of gas. If the mechanism fails or jams, the device will no longer generate rings. In a second, but different device by the same inventor, Whiteis, U.S. Pat. No. 6,736,375, the gas is captured within an inverted bell-like container and is released by an operator momentarily depressing a lever. This opens a valve at the top of the bell thereby creating a flow out of the container. The duration of the flow is determined by the skill of the operator so that some human intervention is required for the device to work.

Finally, an alternative device, developed by the present inventor, U.S. Pat. No. 6,824,125, uses an electric solenoid valve and timing circuit to open and close the flow from a pressure accumulator through a specially configured nozzle. Because of the short time that the valve is open, and because of unique features of the design of the nozzle exit that control capillary effects, very controlled exit flow can be established. Additionally, the sudden acceleration of the flow through the nozzle generates the fluid dynamic vorticity that is known to be essential to the formation of vortex rings. These two features allow very repeatable vortex ring bubbles to be formed on demand and without operator skill. The unique feature of the invention is that it allows one apparatus to develop different size and shaped rings.

This, and the other inventions that have been described, all use specially configured valves, for the creation of a momentary exit of gas flow through a nozzle, in an attempt to establish the favorable conditions that are necessary to give rise to rings. It can be inferred from these inventions, and as is well known from the science of fluid mechanics, that there are two important characteristics that need to be controlled in order that the exiting flow will self evolve into a vortex ring:

1. The first is the strength of the expended pulse of gas, namely its source pressure. A reasonably high source pressure gives rise to a sudden acceleration of the gas when the valves are opened. This creates an exiting flow that is rich in fluid dynamic vorticity which is well known to be important to developing the fluid dynamic circulation needed for forming vortex rings.
2. The second is the time duration of the pulse. The flow into the ring must be sustained for just the right amount of time so that the evolving flow field will self organize into a single ring. If too short, a ring will not fill out. If too long, the ring will be broken up by the subsequent flow.

It is apparent that the various inventions that have been described strive to properly achieve these two conditions by various means. However, from the preceding discussion, a number of observations can be made and which can be summarized as follows:

1. The various configurations generate a pulse flow but generally require a specially sized mechanical valve, or a resilient valve, or a spring loaded valve to control the pulse flow. Some of them even require a second additional, properly-sized valve in order to operate. Indeed, the prior art clearly suggests that a complexity of valves is the only possible way that the right flow conditions can be established for vortex ring bubbles formation.
2. If any of these valves fail mechanically, or leak, the devices will cease to work correctly. For the devices to operate continuously, periodic maintenance is needed to prevent this.
3. Even with proper maintenance, valves such as these will eventually wear out, so that long-term continuous operation of the devices can not be expected.
4. Some of these devices require properly tuned electronic circuits to operate properly. Failure of any electrical component, or loss of electrical power will cause the devices to cease top operate.
5. Some of these devices will not operate independently of human intervention. Indeed, the skill of the operator may even be essential to the successful generation of ring bubbles.
6. Some of the devices, with their multiplicity of valves and moving parts are quite complex and consequently, would not be low-cost to manufacture.

BRIEF SUMMARY OF THE INVENTION

It is therefore an object of the present invention to provide a simple device that employs a method such that once supplied with a source of gas at the appropriate pressure, it will endlessly produce vortex ring bubbles, one after the other, of that gas in a liquid medium.

It is a further object of the invention that the device should not require complex mechanical, elastic or spring loaded valves in order to operate.

It is another object of the invention that the device should not depend on external electronic circuitry in order to operate.

It is yet another object of the invention that it should be maintenance free and not require periodic servicing.

It is yet another object of the invention that it should not wear out after prolonged operation.

It is another object of the invention that it should produce these gas filled vortex ring bubbles continuously without human intervention or operator skill.

These objectives are achieved with a method and a device which, in its simplest embodiment, consists of an inverted cup immersed in a host liquid and which has a short nozzle tube, fitted with end plates, protruding into the cup through the end face of the cup. Because this nozzle tube is shorter than the cup is deep, when the cup is inverted into the liquid, the liquid level in the cup will rise up to the end of the nozzle tube capturing a confined volume of gas in the cup. When this volume of gas is pressurized in a way that does not cause ripples on the confined liquid surface, the liquid surface will be depressed away from the plate on the nozzle tube end face, referred to as the inlet, and will peel off from this inlet. Initially, a surface-tension meniscus will be pinned at the inlet and prevent upward outflow through the nozzle. Eventually however, if the inflow of gas is sustained, the pressure builds up within the cup and breaks the surface tension and releases gas up through the nozzle tube. A mechanism of self acceleration, unique to the invention, causes the gas to exit from the nozzle tube in a short rapid spurt. The liquid in the cup rises in response to the outflow and again contacts the inlet of the nozzle tube, closing off any further flow of gas through the nozzle tube and purging, through a self-siphoning action, any remaining gas from the nozzle tube into the developing bubble at the exit of the nozzle tube. Provided that the components are properly sized, this resulting sudden, short-duration rush of gas from the confined volume up through the nozzle tube creates a gas-filled vortex ring at the external exit of the nozzle.

Alternatively, the exiting flow of gas can be captured in a conical nozzle, positioned above and to one side of the nozzle tube, and directed to the throat of the conical nozzle where it undergoes the same self acceleration and self siphoning to form a gas-filled vortex ring at the throat exit. Alternatively, these elements that have been described can be integrated into a single device in which a segment of the inverted cup, without the nozzle tube, is integrated with the rim of the conical nozzle so that the intermittent breaking of the pinned meniscus takes place at the rim of the conical nozzle feeding a bubble of gas directly into the throat of the conical nozzle.

Thus, the method documented in this Declaration, whereby ring bubbles are generated with the different embodiments of this invention, is through novel design to create intermittent breaking of a pinned mensicus, followed by a self acceleration of the gas in a properly-sized nozzle, followed by a self siphoning action, all of which operate in synergy to provide just the right conditions for ring generation.

Other features and embodiments of the invention for achieving this operation are described and will become apparent from the following drawings and descriptions that are provided.

BRIEF DESCRIPTION OF THE DRAWINGS

The objects and features if the present invention, which are believed to be novel, are set forth with particularity in the appended claims. The present invention, both as to its organization and manner of operation, together with further objects and advantages, may best be understood by reference to the description that follows, taken in connection with the accompanying drawings.

DETAILED DESCRIPTION OF THE INVENTION

Technical Background

The following description is provided to enable any person skilled in the art to make and use the various embodiments of the invention, and to understand the method behind the operation of the various embodiments of the invention, and sets forth the best modes contemplated by the inventor of carrying out his invention. Various modifications, however, will remain readily apparent to those skilled in the art.

Figure 1:
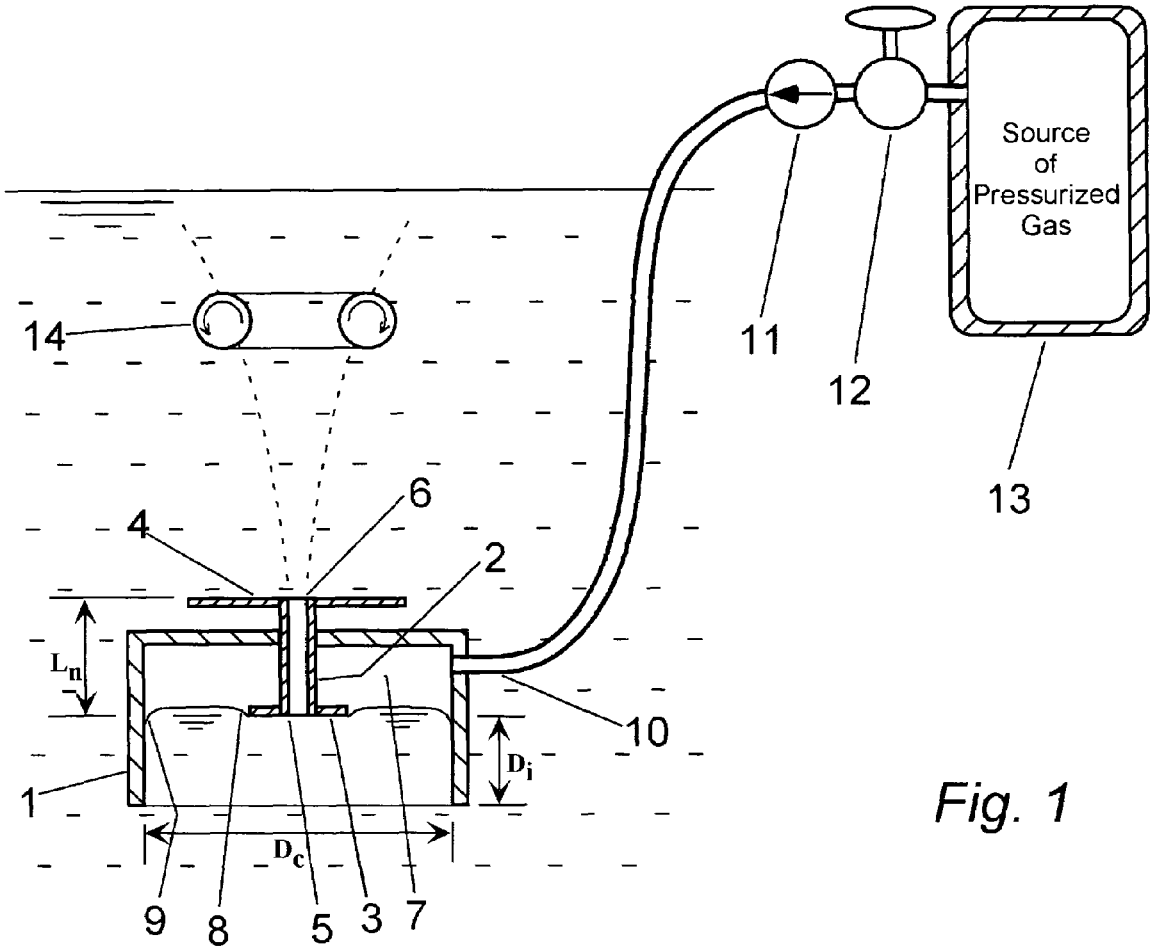
FIG. 1 is a schematic, not to scale, of the preferred and simplest embodiment of the invention. It is suggested that this view be on the front page of the published patent application.
Figure 2:
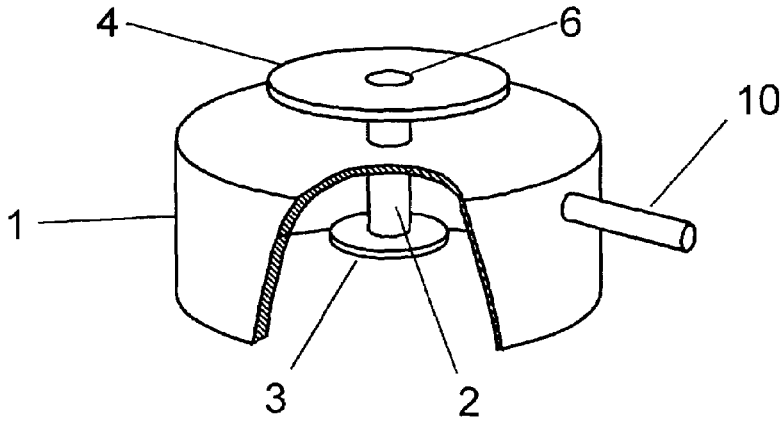
FIG. 2 is a cutaway, perspective view of the same embodiment of the invention.

FIG. 1 depicts the basic embodiment of the invention for producing gas-filled vortex rings in a liquid medium. The salient features of this invention are captured by elements 1 through 10 shown in FIG. 1. The same device is shown in a perspective cutaway view in FIG. 2 and the physics of its operation is presented in the sequence depicted in FIGS. 3A through 3I. It is made of any material that is impervious to the liquid and can not be damaged by chemical reaction with the liquid. It consists of an inverted cup, 1, immersed below the surface of the host liquid. Protruding through the top face of the cup is a circular nozzle tube, 2, that has, at both its end faces, circular plates 3, 4. The plate, 3, will be referred to as the inlet plate, and the plate, 4, will be referred to as the outlet plate. These plates, whose function will shortly become apparent, are attached to the nozzle tube 2, such that the edges, 5, and 6, are sharp right angles, axisymmetric and free from imperfections such as burrs, pits, chips or other imperfections. When the cup is immersed in the liquid, open end down as shown, the liquid will rise up inside the cup, and expel any gas trapped in the cup up through the nozzle tube, 2. But, provided there are no other exit ports, once the confined liquid level reaches the inlet plate, 3, it will no longer rise, and any remaining gas in the cup will be trapped as indicated, giving rise to the confined volume of gas, 7. Because of the inherent surface tension of the liquid, the confined liquid level will contact the inlet plate 3, with a curved meniscus 8, and the inside surface of the cup with a curved meniscus, 9. The approximate radius of curvature of this meniscus, hereafter denoted by $R_m$, is a function of the surface-tension characteristics of the host liquid, the surface finishes of the cup, nozzle and inlet plate and, to a lesser extent, the materials from which they are made.

The confined volume of gas, 7, above the liquid level in the cup is further connected through a feedline tube or hose, 10, through a unidirectional check valve, 11 and through a regulating valve 12, to a source of the desired gas under pressure, 13. In the embodiment of FIG. 1, this is shown located above the surface of the liquid although it need not necessarily be. It may be a tank of compressed gas, or a pump that provides the gas under pressure. By adjustment of the regulating valve 12, the pressure and flow rate of gas into the inverted cup, 1, can be controlled to any desired steady level. The check valve, 11, is simply to prevent back flow into the gas source should the source pressure from 13 fall below the local static pressure in the liquid at the cup location. It is not necessary to the successful operation of the invention. The important point is that elements 11, 12, and 13, are just one of many possible ways to provide a controlled steady bleed of gas that drives the operation of the device through its introduction into the device with the tube, 10, just above the confined liquid level. As will become apparent, the device does not require this flow to fluctuate or to be cyclically varied in order for the device to function. It merely needs to be a slow and steady flow, or bleed, of gas under a pressure that is adequate to overcome the local hydrostatic pressure within the cup, 1. The discussion that follows will therefore concentrate on the main elements of the invention which are numbered 1 through 10 in FIG. 1.

Figure 3A:
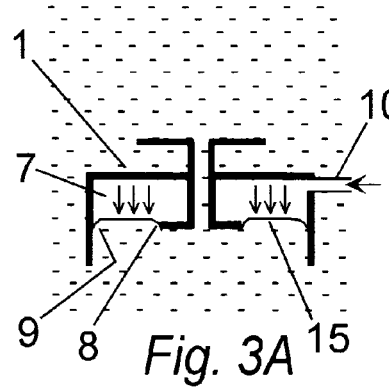
FIGS. 3A through 3I depict the sequence of events behind the operation of the preferred embodiment of FIG. 1, such that vortex-ring bubbles are produced.

The nine cross-sectional views in FIG. 3A through FIG. 3I show the sequence of events leading to ring generation as the gas is slowly bled into the device through the feedline, 10. Each step in the process will now be explained in reference to each cross-sectional view:

FIG. 3A: When the flow enters the device through the feedline, 10, the gas pressure in the confined volume, 7, is increased, causing the gas to push down on the liquid level, 15, as shown. Because the gas is introduced above the liquid level within the cup, there are no bubbles or disturbances introduced and the liquid surface, 15, within the cup remains smooth and free of waves.

Figure 3B:
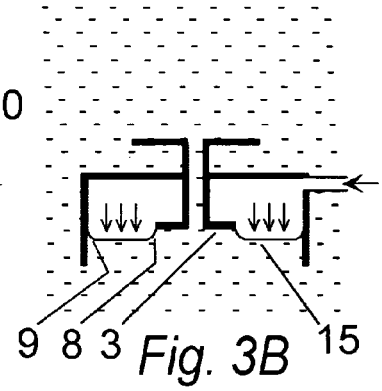

FIG. 3B: Because of the adhesion of the liquid to the inlet plate, 3, the initially convex liquid surface, 15, is depressed down and becomes largely concave, as shown. The menisci, 8 and 9, which were convex, become concave as the liquid level falls.

Figure 3C:
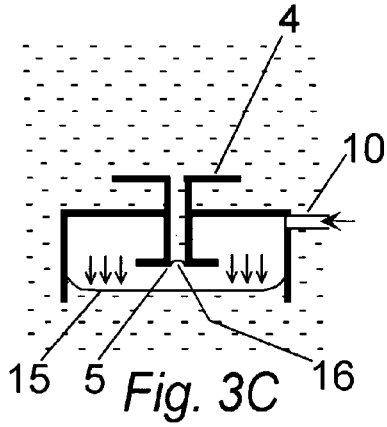

FIG. 3C: As the pressure rises further, the liquid surface becomes more and more distended, until it finally peels away from the inlet plate, 3. An important feature captured by the present invention, is that the gas does not yet drive up the nozzle tube and squirt out through the outlet nozzle plate, 4. This is because surface tension forces, sometimes called capillary effects, cause another small curved meniscus, 16, to form between the gas and the liquid at the sharp edge, 5, of the inlet of the nozzle tube, and remain pinned at that sharp edge. This effectively prevents outflow so that the pressure can slowly rise further within the cup as more gas enters through the feedline, 10. In fact, for a meniscus radius of curvature $R_m$, the pressure that the meniscus, 16, can sustain is given by $\sigma/R_m$, where $\sigma$ is the surface tension coefficient of the liquid. If the nozzle radius, $R_n$, is equal to or smaller than $R_m$, then the pressure that the meniscus can sustain is approximately $\sigma/R_n$. For that case, this pressure thus varies inversely with the nozzle radius and is larger for smaller nozzles. The difference in liquid level between the meniscus, 16, and the liquid level, 15, expressed as a pressure or head, will approximately equal this surface-tension pressure. As the pressure rises further within the cup and pushes against the pressure created by the surface tension, the meniscus, 16, becomes more distended and the liquid level, 15, is further depressed. Because the gas has been introduced above the liquid level, it does not create disturbances or agitation in the liquid which could splash and disturb the meniscus, 16, and cause gas to randomly bubble up the nozzle tube.

Figure 3D:
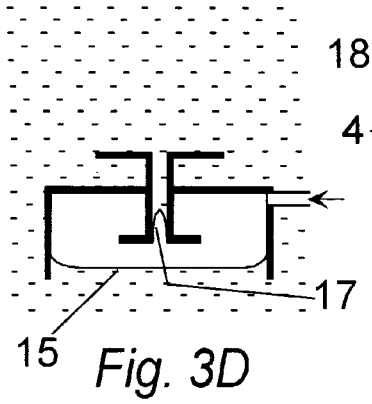

FIG. 3D: Eventually, however, as gas continues to be introduced, the hydrostatic pressure difference soon becomes adequate to overcome the surface-tension pressure and the gas does start to drive the meniscus up the nozzle. The meniscus is now a moving liquid/gas interface or contact line, 17, that travels up the inside surface of the nozzle. Since the cup is wider than the nozzle, the level, 15, of the level of the liquid in the cup does not cange much in response, but the level of the rising meniscus and contact line 17, does. The pressure, that is hydrostatic head, driving the flow up the nozzle is the difference between the liquid level, 15, and the height of the gas/liquid interface, 17. As already mentioned, before the meniscus started to move, the difference in these levels was of the order of $\sigma/R_m$. However, as the meniscus rises, the difference in the liquid levels increases, so the effective head is increased, and this causes the meniscus to move faster, which causes the head difference to be even larger, which even further accelerates the meniscus travel up the nozzle. The consequence is that the pressure difference driving the meniscus up the nozzle grows very rapidly in time, causing the meniscus to self accelerate, or in mathematical parlance, it advances exponentially with time. Dimensional analysis, a tool used frequently to characterize fluid dynamic systems, suggests that, ignoring viscosity, the time scale of this growth is of the order of $(L_n/g)^{1/2}$, where g is the acceleration due to gravity, and $L_n$ is the length of the nozzle tube, 2. This can be quite short; for example, it is only about 30 milli-seconds for a 1 cm long nozzle tube. The consequence is that the gas rising up the nozzle might start relatively slowly, but then it suddenly accelerates and spurts out of the nozzle outlet with considerable speed. This feature, hereafter referred to as self acceleration, is an important and novel feature to the design of the present invention since, as has been discussed, imparting a rapid acceleration to the flow is important to vorticity production, the first of the two important conditions that must be imparted to a flow for subsequent vortex ring formation. The gas will emerge with considerable energy, especially if the liquid also easily wets the inside of the nozzle, that is, if surface effects do not slow down the moving contact line. Any natural wetting can be augmented by roughening the inside surface of the cup with sand paper or grit since it is well known that that the resulting surface texture greatly enhances liquid wetting of a surface.

Figure 3E:
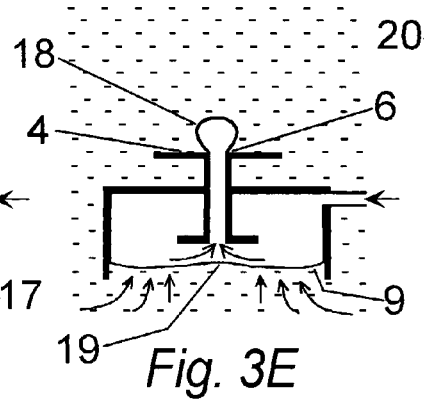

FIG. 3E: As depicted in this view, as the gas flow accelerates out through the nozzle tube, it emerges as an initially small bubble, 18, spreading laterally at the outlet plate. Because of the sharp, symmetric edge, 6, of the nozzle tube outlet at the outlet plate, this bubble will emerge cleanly, and symmetrically. Since the incoming bleed of gas through the feedline, 10, is relatively small, the liquid level within the cup will rise up inside the cup to match the volume of expelled gas. As indicated by 19, it will rise more slowly than the outflow velocity through the nozzle tube and it will tend to be drawn up more in the center of the cup than at the edges. This rising liquid can be thought of as being like a rising piston helping to pump the gas out. The meniscus, 9, along the inside wall of the cup becomes another upward moving liquid/gas contact line. Provided the liquid wets the inside surface of the cup, this contact line can move with ease. Therefore the wetting can be important, especially for small cups, since it enables a steady and spatially symmetric rise of the liquid back up the inside of the cup as needed to symmetrically help pump the gas out through the nozzle. For such cases, the natural wetting can be augmented artificially by etching small grooves or roughness into the inside surface of the cup with sandpaper.

Figure 3F:
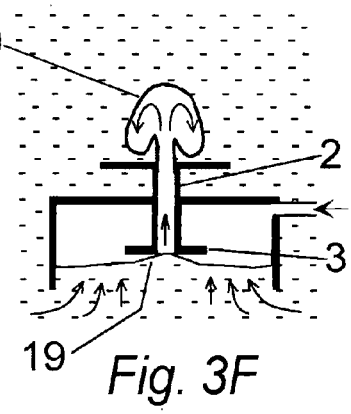

FIG. 3F: Because of the fast acceleration of the emergent gas from the nozzle tube, 2, the viscous condition of no fluid dynamic slip along the inside nozzle tube surface, causes an enhanced generation of vorticity within the rising gas plume inside the nozzle tube. This vorticity feeds into the bubble and creates a nascent bubble vortex ring, 20, forming at the outlet plate. The presence of the flat circular outlet plate helps stabilize and preserve the symmetry of that emerging bubble. At this point, provided the components are properly sized, the liquid level, 19, rises up inside the cup and just makes contact with the inlet plate, 3, thereby shutting off any further flow of gas up into the nozzle tube. Thus, it can be appreciated, that by the unique design features of the invention, a short duration pulse of gas has been generated from a steady (i.e. unchanging) flow from the source of gas. The device therefore provides the second important flow condition needed for vortex ring production, namely a short duration flow through a nozzle. This specialized control, hereafter referred to as intermittent breaking of surface tension, is an important and unique innovation of the present invention.

Figure 3G:
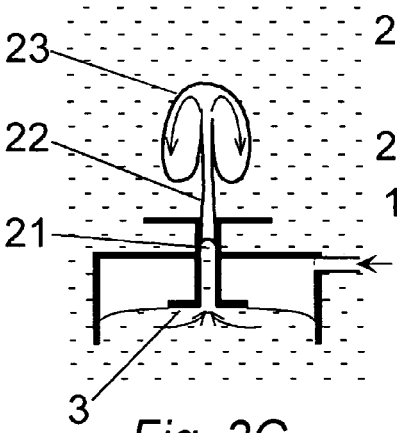

FIG. 3G: As the rising liquid level in the cup spreads over the inlet plate, 3, it adheres to the plate. Because the inlet plate is present, any tendency of the liquid level to slosh back down under wave action and re-open gas flow into the nozzle tube is prevented. To augment the adherence of the liquid to the plate, it is desirable that the liquid wet the plate, or be treated to augment the natural wetting. As before, roughening the surface with sandpaper, or machining small grooves in face of the plate are very effective ways of achieving this. Liquid, 21, now enters the nozzle and rises up the nozzle in a siphoning action that drives any remaining gas out of the nozzle. This action will hereafter be referred to as self siphoning. The emergent mushroom-shaped bubble, 23, at the outlet grows larger as the gas, 22, emanating from the nozzle tube squirts into its center to be drawn into the head of the bubble.

Figure 3H:
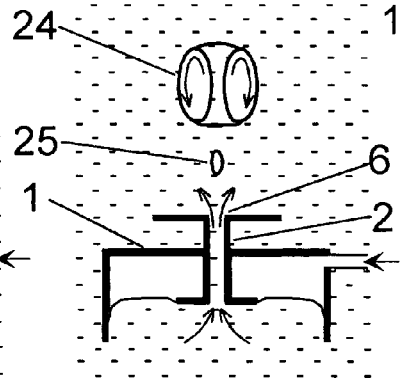

FIG. 3H: The liquid level in the cup ceases rising although some liquid may is still carried under momentum through the nozzle tube into the bubble. The resulting liquid outflow at the outlet of the nozzle tube, 6, and the internal vortex circulation of the bubble, 24, draws all of the remaining gas, 22, into the developing bubble, followed by liquid. A small amount of gas may pinch off and remain as a tiny trailing bubble, 25. Properly sizing the diameter of the cup, 1, in relation to the diameter of the nozzle, 2, can minimize the size of this bubble, if not eliminate it.

Figure 3I:
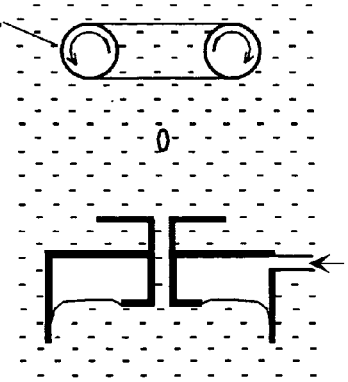

FIG. 3I: Because the bubble, 24, is rich in vorticity and circulation, after traveling a short distance, the self-organization mechanism discussed previously, draws liquid up into its central core and forms a well-defined vortex bubble ring, 14. At this point, provided the gas flow into the cup is maintained through the feedline 10, the entire process will start all over again, so that the device will produce an endless succession of rings, and with no intervention.

To one skilled in the art, it can now be appreciated that this invention offers a very simple device that can produce bubble rings. It does this by creating short pulses of gas into the host liquid and operates through an innovative design that forces the liquid itself to act as a valve to control an emerging gas flow. It achieves this with considerable ease, and with no moving parts. As might be expected, the components do need to be sized properly in relation to one another, as improper sizing will just lead to gurgling or chaotic streams of bubbles, or intermittent bubbles with no coherence. But it is the experience of this inventor, that if the components are sized properly in relation to one another, so as to give the right emergent pulse strength and duration, then rings will form. It is an easy process to determine the necessary component sizes through experimentation. It is the further experience of this inventor that the required optimal sizes of the different components depend on the size of the rings that are desired, the physical properties of the liquid being used, and to a lesser extent, the surface characteristics of the materials that are used. In general, larger nozzle diameters and correspondingly larger components are used if larger rings are desired. Indeed, for any given nozzle radius $R_n$, host liquid, and device material, there are only three major additional dimensions that essentially characterize this embodiment of the invention. These are:

1. The length of the nozzle tube, 2, denoted by $L_n$.
2. The internal diameter, or width of the cup, 1, denoted by $D_c$,
3. The distance from the inlet end plate of the nozzle tube, 3, to the lower opening of the cup, denoted by $D_i$.

These dimensions are shown in FIG. 1. The other dimensions of the device such as the inlet and outlet plate radii, and the cup wall thickness etc., have only a secondary bearing on the operation of the invention. It is the experience of this inventor, that once the three major dimensions, $L_n$, $D_c$ and $D_i$ are properly determined through experimentation for a given $R_n$, the resulting device, when supplied with gas under pressure, will easily produce an endless sequence of rings.

The device then operates by creating a pulsed flow through the intermittent breaking of pinned surface tension. Self acceleration and self siphoning cause this pulsed flow to form ring bubble vortices. The frequency of the ring formation is simply controlled by changing the rate at which gas is fed to the device. For example, if that flow is slowed down, then the process shown in FIG. 3 occurs at a slower rate and the rings form at a slower repetition rate. If it is speeded up, then rings will form at a faster rate. Thus, by simply adjusting the control valve, 12, the ring generation rate can be directly and easily changed.

Advantages Over the Prior Art

From the preceding description, it can be appreciated that through careful design, the invention will generate gas-filled vortex rings in a host liquid. The obvious simplicity of the device clearly stands out as one major benefit it offers. But it is also apparent that it offers several additional advantages over the devices of other inventors that were described previously:

1. The device is an innovative means of producing the periodic rapid pulsed flow needed for ring generation. It does not require one or more mechanical valves, elastic valves, or spring loaded valves. Other than any mechanism that might be used to create the source of gas pressure, it is mechanism-free, and has no moving parts. That this is possible is certainly not obvious from the prior art which suggests that a complex multiplicity of valves are the only way to produce the flow required for ring bubble formation.

2. Because it is mechanism-free and has no moving parts, it will not require any periodic servicing or maintenance.

3. Because it is mechanism-free and has no moving parts, it will not wear out and will provide near-endless operation, so long as a source of pressurized gas is provided.

4. It does not require any sophisticated electronic circuits to operate, and, other than what might be needed for the pressurized source of gas, it does not require electrical power to function.

5. The device will operate independently of human intervention and requires no operator skill in order to function.

6. Because it is mechanism-free, and has no moving parts, and no electrical components, it is simple and low-cost to manufacture.

ALTERNATIVE EMBODIMENTS

To one skilled in the art, it is apparent that the invention offers a unique approach to generating gas-filled bubble rings, and provides a unique method for creating the pulsed flow that is known to be required for generating such rings. It is also apparent that similar devices can be conceived which might have slightly different geometries and different relative sizes of the individual components but which are merely alternative embodiments of the present invention.

Figure 4A:
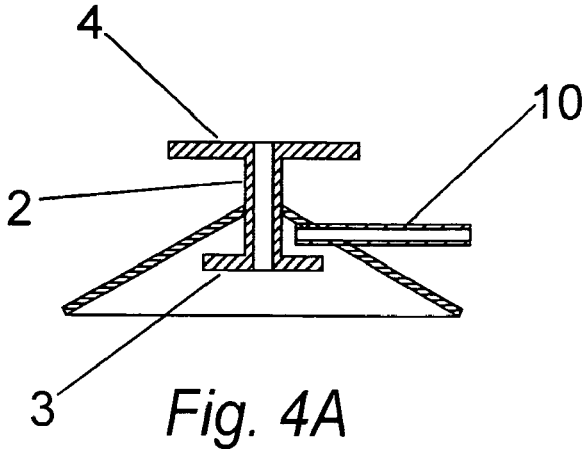
FIGS. 4A and 4B depict an alternative embodiment of the invention shown in FIGS. 1 and 2, in which the cylindrical cup of FIG. 1 is replaced with a conical cup.
Figure 4B:
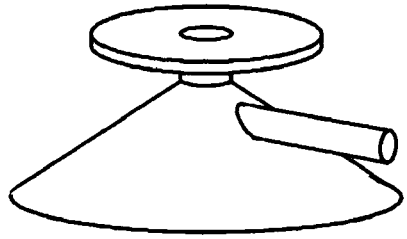
Figure 5A:
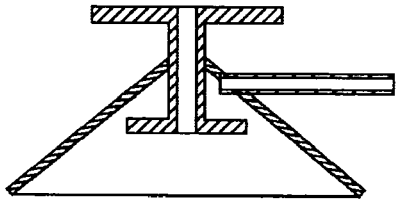
FIGS. 5A and 5B depict an alternative embodiment of the invention shown in FIGS. 1 and 2, in which the cylindrical cup of FIG. 1 is replaced with a tetrahedral cup.
Figure 5B:
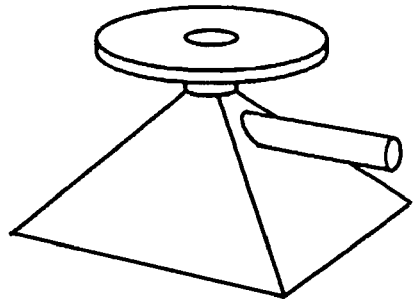
Figure 6A:
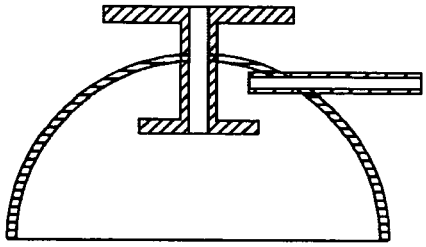
FIGS. 6A and 6B depict an alternative embodiment of the invention shown in FIGS. 1 and 2, in which the cylindrical cup of FIG. 1 is replaced with a hemispherical cup.
Figure 6B:
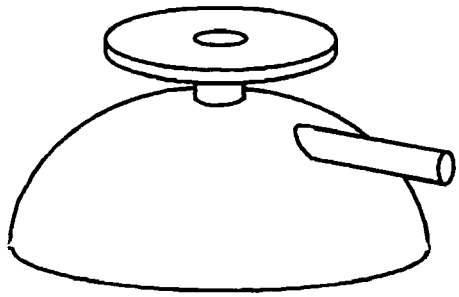

For example, FIGS. 4, 5 and 6 show alternative embodiments based largely upon changes to the geometry of the cup, 1, but which are functionally identical to the device in FIG. 1. The first of these in FIGS. 4A and 4B, is a concept in which the cylindrical circular cup, 1, is made in the form of a cone. Likewise, FIGS. 5A and 5B show a concept in which it is made from a tetrahedral or pyramidal shape, while FIGS. 6A and 6B show the use of a hemispherical cup to provide the function of the cup, 1. Evaluations by the present inventor have shown that despite the different cup geometries, after correct sizing of the components, they will function satisfactorily in the production of gas-filled vortex rings by the same physical process as documented in FIG. 3.

Figure 7A:
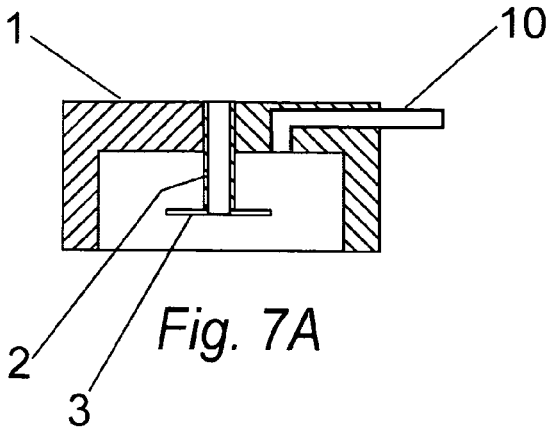
FIGS. 7A and 7B depict an alternative embodiment of the invention shown in FIGS. 1 and 2, in which the nozzle tube exit plate of FIG. 1 is integrated with circular end face of the cylindrical cup.
Figure 7B:
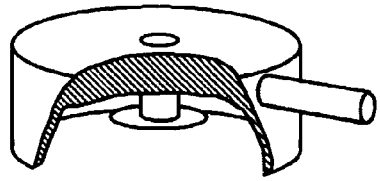
Figure 8A:
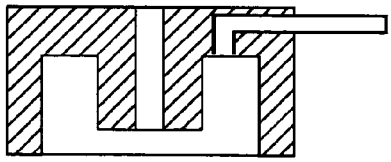
FIGS. 8A and 8B depict an alternative embodiment of the invention shown in FIGS. 1 and 2, in which the nozzle exit plate of FIG. 1 is integrated with the cylindrical cup and the nozzle inlet plate is integrated into the nozzle tube walls.
Figure 8B:
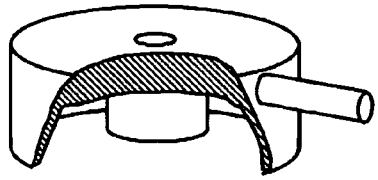
Figure 9A:
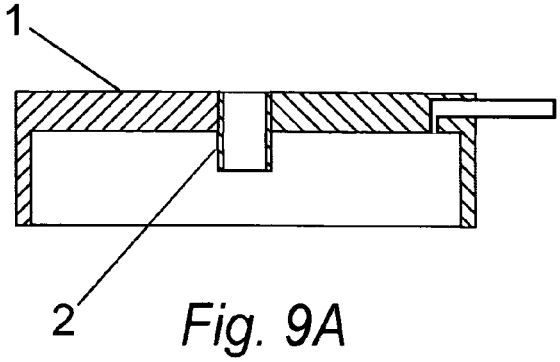
FIGS. 9A and 9B depict an alternative embodiment of the invention shown in FIGS. 1 and 2, in which the nozzle tube outlet plate of FIG. 1 is integrated with the cylindrical cup, and the nozzle tube inlet plate is removed.
Figure 9B:
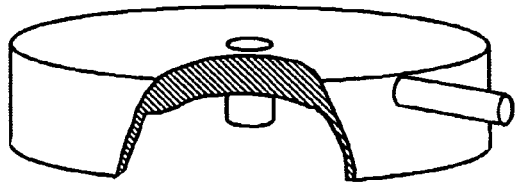

FIGS. 7, 8 and 9 show alternative embodiments based, instead, upon changes to the geometry of the nozzle tube, 2, and end plates, 3 and 4. These embodiments are also functionally identical to the device in FIG. 1. The concept in FIGS. 7A and 7B has the outlet plate, 4 integrated into the top of the cup 1. Also, the feedline, 10, projects into the top of the cup, rather than into the side, as in FIG. 1. Experimental determination by this inventor has shown such a configuration is to be preferred when small rings are desired from small nozzle tubes, that is when the nozzle tube radius $R_n$ is of the same order as the radius of curvature of the contact meniscus, defined previously as $R_m$. Roughening the salient wetted surfaces, as described previously, improves the operation of the devices. Nonetheless, one skilled in the art will recognize that the device in FIGS. 7A and 7B is functionally the same as FIG. 1. The concept in FIGS. 8A and 8B continues the same theme, where now the nozzle end plate, 3, is further integrated with the external shape of the nozzle tube, making the cup, nozzle and end plates a single element that can be easily machined from a single piece of material. The concept in FIGS. 9A and 9B is similar, and is the simplest embodiment which the inventor has found to successfully generate rings when large rings are desired from larger nozzle tubes. In such cases the nozzle tube radius $R_n$ is larger than the radius of curvature of the contact meniscus radius, $R_m$, and evaluations by the inventor have shown that wide, flat cups are needed. Also, although an inlet end plate, 3, may be used, it is usually not necessary since that is mostly required for small nozzle tubes to prevent sloshing of the rising liquid level, 19, shown previously in FIG. 3F. Thus, although the relative sizes of the components may be different from those in FIG. 1, it is functionally identical with the exception that the inlet plate is not present, and the outlet plate is integrated into the top of the cup, 1, as a single component.

One skilled in the art will recognize that all the different embodiments depicted in FIG. 4 through FIG. 9, may have different sizes and shapes, but, importantly, they all can be made to operate by the same physical process which has been summarized in the sequence of FIG. 3. In all cases, innovative use is made of the intermittent breaking of surface tension, which, by careful design, causes the liquid to act as a valve to control the flow of a gas flow through a nozzle. By further proper design, self acceleration and self siphoning of this flow creates the ring bubbles. Thus, the embodiments have established the two conditions necessary for gas-filled vortex ring formation. Firstly, the embodiments create the elevated pressure difference and conditions needed to rapidly accelerate the flow. Secondly, they create a flow pulse that lasts for the required short duration.

Figure 11A:
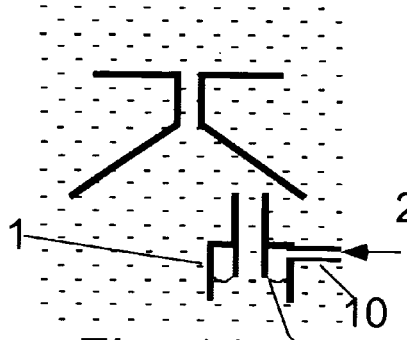
FIGS. 11A through 11I depict the sequence of events behind the operation of the embodiment of FIGS. 10A and 10B, such that vortex-ring bubbles are produced.

To one skilled in the art, it will be further recognized that once the optimal geometry of any of these embodiments is defined, then each will operate at a single performance condition and repeatably produce rings of one given size and one given intensity (i.e. fluid dynamic circulation). A further embodiment of the invention, shown in FIGS. 10A and 10B, expands the operating range of the invention such that it can produce various levels of ring intensity, i.e. vortex circulation, for a particular given ring size. It can be recognized as being the device in FIG. 1, with the addition of a conical nozzle and throat, 26, above and laterally offset from the centerline of the device of FIG. 1. In the discussion that follows the term conical nozzle will be used for this feature, but it is understood that other geometries are possible, such as tetrahedral and hemispherical. Also, in this embodiment, the nozzle tube, 2, may have a larger diameter relative to the cup diameter, as shown, and the inlet and outlet plates are removed. Instead, the outlet plate, 4, and its sharp exit edge, 6, are now placed at the end of the throat of the conical nozzle, 26. Although the relative proportions of the cup, 1, and nozzle, 2, are changed as indicated to facilitate the operation of the embodiment, as before, both are used to create the pulsed flow of gas through the nozzle tube, 2. The conical nozzle, 26, is used to capture this gas and create the conditions for ring formation. It operation is summarized in the sequence depicted in FIGS. 11A through 11I, and which is now described:

FIG. 11A: The meniscus of the captured liquid level in the cup, 1, is assumed to be as depicted. It may have been initially convex but has been depressed by the incoming bleed of gas through the feedline, 10.

Figure 11B:
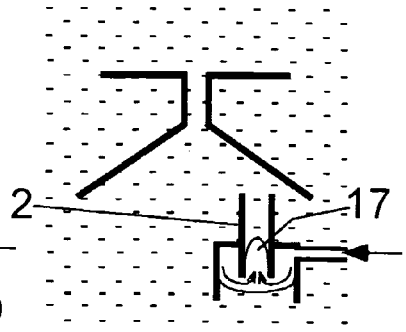

FIG. 11B: Under the influence of the rising pressure, the liquid level falls, the meniscus, 8, is strained at the pinned edge, eventually tearing free and causing a bubble with a curved liquid/gas interface, 17, to start to rise up the tube, 2, as was also seen in FIG. 3D.

Figure 11C:
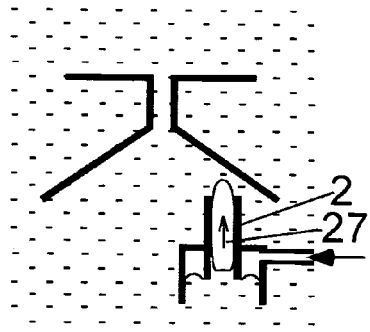

FIG. 11C: Eventually, by analogy with what was described for FIG. 3, the liquid level in the cup rises once again, closing off flow of gas into the nozzle, 2. Because of the larger relative diameter of the nozzle, this now leaves an isolated bubble, 27, within the tube which rises steadily up the nozzle, 2, as shown. The second of the two conditions needed for ring bubble formation, namely a short duration flow of gas, has thus been created by the same process depicted in FIG. 3.

Figure 11D:
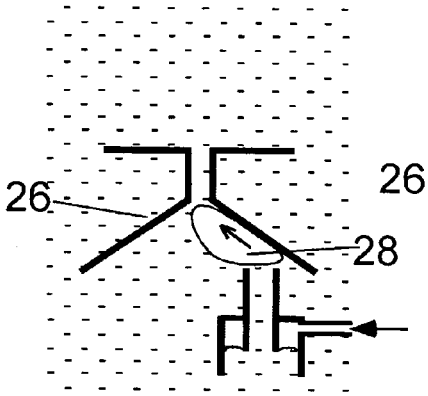

FIG. 11D: The bubble exits the nozzle as a discrete bubble, 28, which strikes the conical surface, 26, off axis by virtue of the off axis positioning of the nozzle relative to the cone. It then slides upwards along the conical surface under buoyancy forces.

Figure 11E:
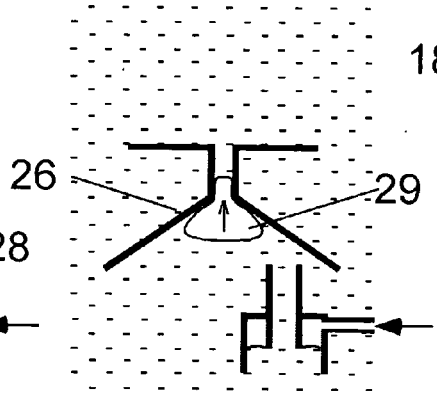

FIG. 11E: The bubble accelerates rapidly under buoyancy forces up the inclined surface toward the throat of the conical nozzle, 26, and is captured there, as shown. Because of the narrowness of the throat, it can not immediately pass through the throat, but is stalled and is pushed into a largely axisymmetric shape under buoyancy forces. It then starts to rise up the throat and just as the rising meniscus of FIG. 3D rapidly self accelerates upwards, so the upper gas/liquid interface of bubble, 29, rapidly self accelerates up through the throat of the conical nozzle, 26.

Figure 11F:
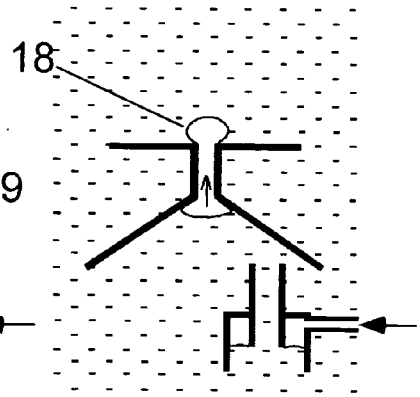

FIG. 11F: As was described for the circumstances of FIGS. 3D and 3E, the upper gas/liquid interface of the bubble travels through the conical nozzle throat at an exponentially growing faster rate, such that it spurts out of the throat exit forming a nascent ring bubble, 18, just as was seen in the embodiment shown in FIG. 3E. The other condition for ring generation, namely an adequate pressure difference to impulsively accelerate the flow, has thereby been created.

Figure 11G:
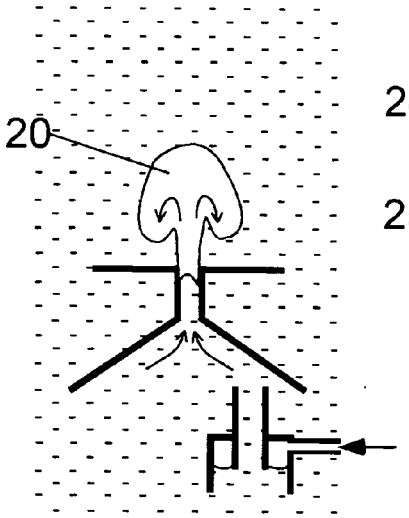

FIG. 11G: The self-siphoning action seen in the embodiment in FIG. 3G again takes place in the throat, and draws liquid back up into the throat to drive the captured gas up in to the developing ring bubble, 20.

Figure 11H:
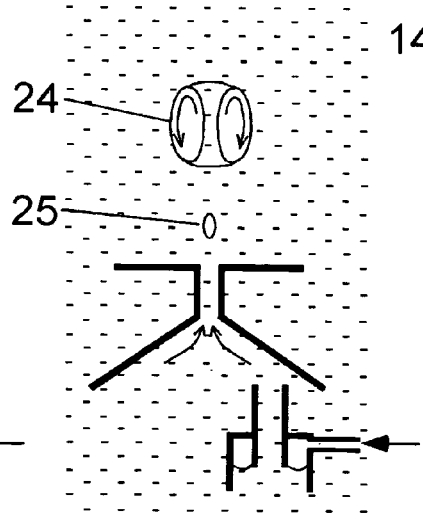

FIG. 11H: The sudden acceleration to which it has been subjected imparts the emerging gas bubble with the necessary vorticity to drive the formation of an evolving vortex structure, 24, sometimes pinching off a small trailing bubble, 25, in its wake. Proper sizing of components can reduce, if not eliminate this trailing bubble.

Figure 11I:
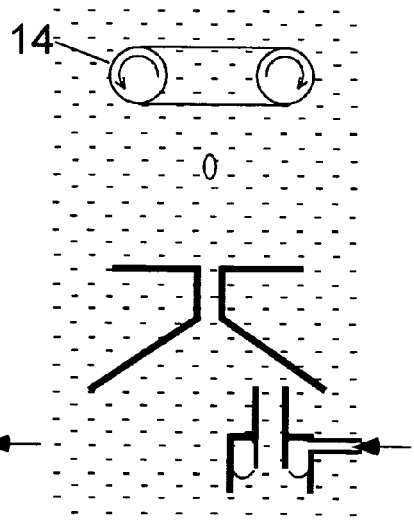

FIG. 11I: The rising vortex structure 24, is subject to the same self-organizing effects described previously and evolves into a rising gas-filled ring bubble, 14. The device is now ready for the entire sequence to be repeated leading to the repetitive generation of ring bubbles.

In this embodiment, intermittent breaking of surface tension pinned at a sharp edge is again used to generate a pulsed gas flow that is directed to a conical nozzle throat where it self accelerates and self siphons so that with proper sizing, it produces just the right conditions to generate a ring bubble. The feature offered by this embodiment is that the conical nozzle geometry, 26, is now decoupled from the geometry of the cup, 1, and nozzle tube, 2, that produce the pulsed flow and can be changed independently of that geometry. It is the experience of this inventor that variations to the size and shaping of the conical nozzle, 26, thereby allow this embodiment to generate different ring intensities for a given volume of pulsed flow issuing from the nozzle tube, 2, that is, for a given ring size. Thus, this embodiment greatly expands the allowable family of ring bubbles that the invention can generate.

Figure 12A:
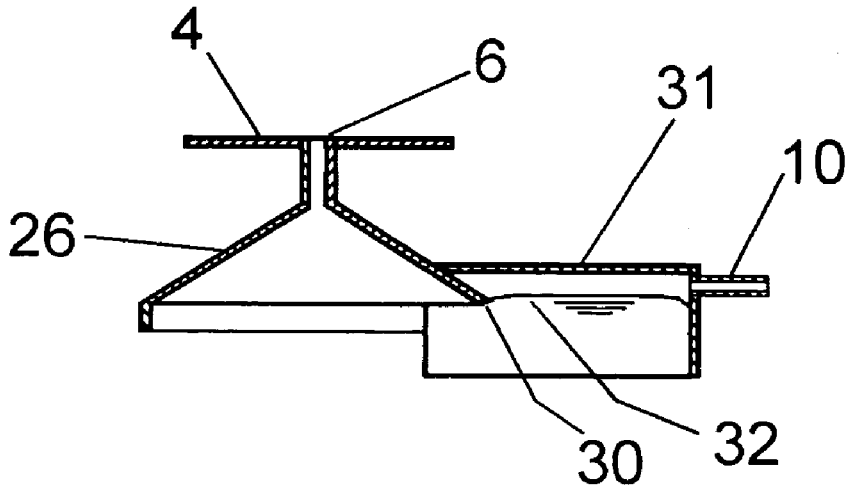
FIG. 12A and FIG. 12B depict an alternative embodiment of the invention shown in FIGS. 10A and 10B, in which a segment of the cylindrical cup and nozzle of the embodiment of FIG. 1 and FIG. 2 are integrated into one side of the conical nozzle of the embodiment of FIG. 10A and FIG. 10B.
Figure 12B:
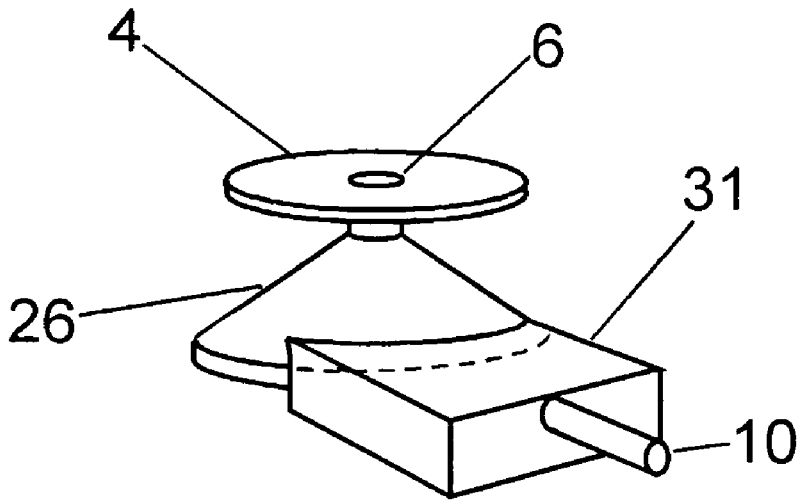
Figures 13A, 13B, 13C, 13D, 13E, 13F, 13G, 13H, 13I:
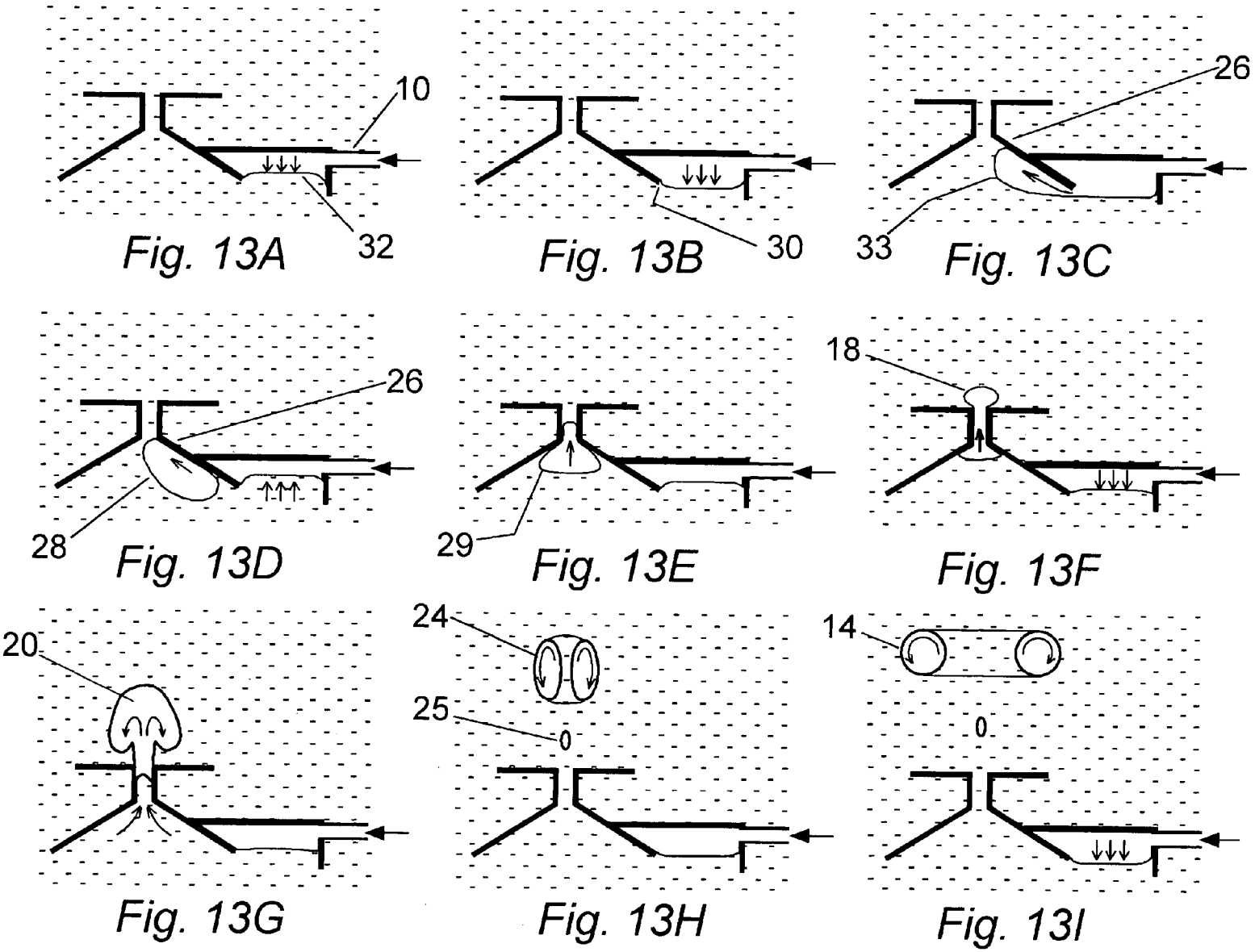
FIGS. 13A through 13I depict the sequence of events behind the operation of the embodiment of FIG. 12A and FIG. 12B, such that vortex ring bubbles are produced.

To one skilled in the art, it can now be recognized that all these various embodiments have the same essential method of operation, namely intermittent breaking of pinned surface tension to create a pulsed flow, followed by self acceleration and self siphoning through a nozzle or throat to create a ring bubble. Likewise, to one skilled in the art, many other embodiments using the same physics of operation can also be conceived and although they may have different geometry, they will be functionally identical to the embodiments that have been described. It is intended that this Patent Declaration should also encompass such devices within the scope of the invention as described and claimed, whether or not expressly described. For example, one further embodiment of the invention, is based on the previous embodiments that have been depicted, and operates by the same physics, and is shown in FIGS. 12A and 12B. In this embodiment, the site of the meniscus pinning that generates the pulsed flow is achieved at the rim, 30, of the conical nozzle, 26, itself, which since it has outlet, 6, as in the previous embodiments, is therefore functionally the same as fitting a conical inlet to the inlet of nozzle, 2, of the embodiment in FIG. 1. The volume, 31, performs the same function as the cup, 1, in FIGS. 1 through 9, namely accumulating the gas above a confined liquid surface, 32. However, whereas the cup fully surrounds the nozzle of the device of FIG. 1, in this embodiment the volume is derived from a partial, or reduced segment of the cup, 1, partially surrounding the rim of the conical nozzle, 26, that is, partially wrapping around the conical inlet of the nozzle. Likewise, the gas is released by the breaking of the pinned meniscus at the edge of the rim, 30, as takes place at the rim of the nozzle inlet, 5, in the embodiment in FIG. 1. As will become apparent, this device is functionally the same as the embodiments in FIGS. 1 through 9, with the components that generate the pulsed flow being integrated together, while still retaining the capability to be independently sized. By analogy with the sequence in FIGS. 11A through 11I and the sequence in FIGS. 3A through 3I, the corresponding operation of this embodiment is shown in the sequence of FIGS. 13A through 13I:

FIG. 13A: The meniscus of the captured liquid level, 32, is assumed to be as depicted, namely initially convex and being depressed by the inflow of gas from the feedline, 10.

FIG. 13B: As before, under the influence of the rising pressure, the liquid level falls, and the meniscus becomes concave, and strained at the pinned edge, 30.

FIG. 13C: Eventually, by analogy with what was described in the embodiment of FIG. 3, and the embodiment of FIG. 11, the meniscus yields to the rising pressure, and gives way, releasing a tongue of gas, 33, rising up and into the conical nozzle, 26.

FIG. 13D: The efflux of gas into the nozzle cone causes the liquid level to rise back up, severing from the tongue of gas, 33, thereby leaving a discrete bubble, 28, as was seen also in the embodiment in FIG. 11D. As before, this bubble is also driven by buoyancy forces and slides up the inclined surface of the nozzle cone, 26.

FIG. 13E: The bubble accelerates rapidly toward the throat of the nozzle cone, as shown, and because of the narrowness of the throat, it can not immediately pass through the throat, but is stalled and is pushed into a largely axisymmetric shape under buoyancy forces. It then starts to rise up the throat and just as the rising bubble shown in the sequences of FIG. 3D and FIG. 11E rapidly self accelerates upwards, so the upper gas/liquid interface of bubble, 29, rapidly self accelerates up through the throat.

FIG. 13F: As in the sequences of FIG. 3F and FIG. 11F, the gas/liquid interface of the bubble travels up the throat at an exponentially growing faster rate, such that it spurts out of the throat exit forming a nascent ring bubble, 18, just as was seen in the previous embodiments.

FIG. 13G: The self-siphoning action seen in the embodiments in FIG. 3G and FIG. 11G again takes place and draws liquid up into the throat to drive the captured gas up in to the developing ring bubble, 20.

FIG. 13H: Once again, the sudden acceleration to which it has been subjected has imparted the emerging gas bubble with the necessary vorticity to drive the formation of an evolving vortex structure, 24, sometimes pinching off a small trailing bubble, 25, in its wake. Proper sizing of components can reduce, if not eliminate this trailing bubble.

FIG. 13I: The rising vortex structure, 24, is subject to the same self-organizing effects described previously and evolves into a rising gas-filled ring bubble, 14. The device is now ready for the entire sequence to be repeated leading to the repetitive generation of ring bubbles.

Figure 10A:
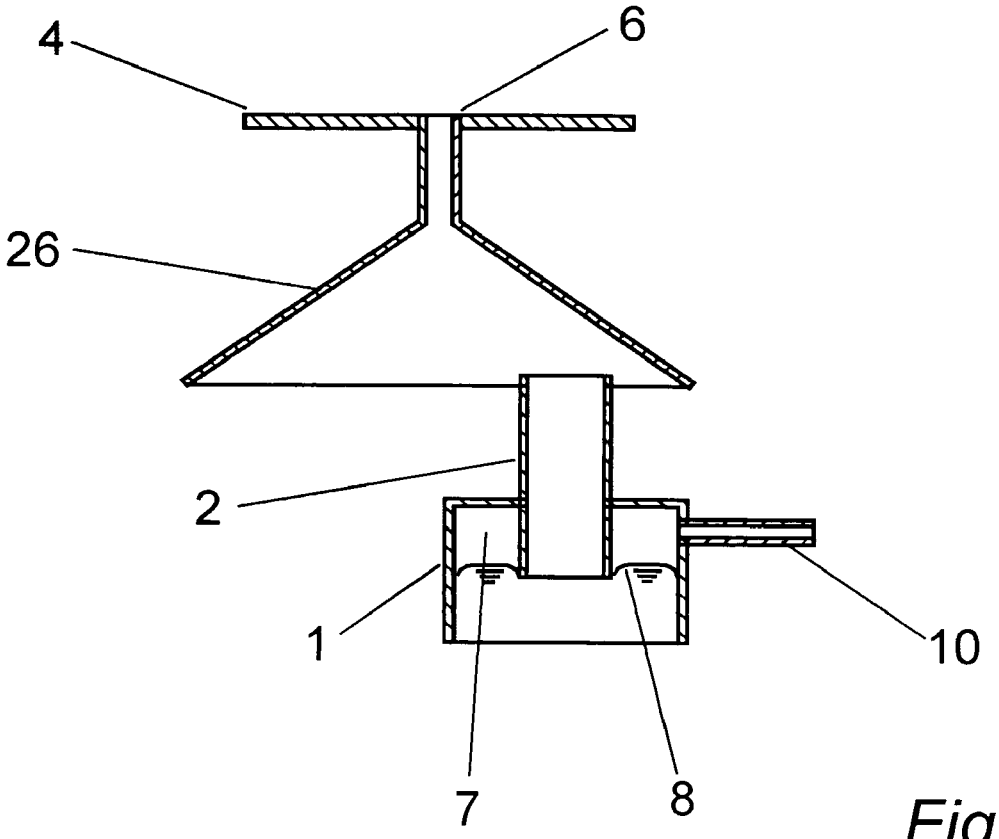
FIGS. 10A and 10B depict an alternative embodiment of the invention shown in FIGS. 1 and 2, in which a conical nozzle and throat have been place above the embodiment of FIG. 1, but which has a larger relative diameter of nozzle tube, and whose inlet and outlet plates are removed.
Figure 10B:
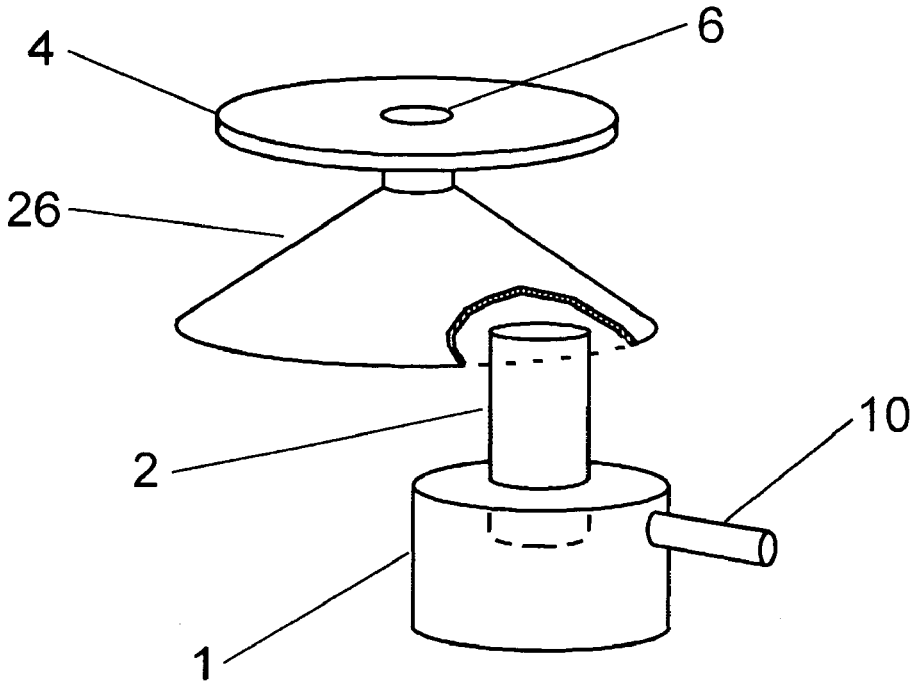

The similarity in operation of the embodiment in FIGS. 10A and 10B with that in FIGS. 12A and 12B is now apparent. Both operate by the same physical process of breaking pinned surface tension followed by self acceleration and self siphoning through a narrow tube, in this case the nozzle throat. By changing the width and length of the volume, 31, the volume of trapped gas can be changed which changes the amount of gas released to the conical nozzle, and thereby changes the size and strength of the vortex ring that develops. Therefore, the embodiment of FIGS. 12A and 12B carries the same advantages of the widened range of operation as for the embodiment in FIGS. 10A and 10B, and is functionally identical, but it achieves this operation with more integration of the elements.

Indeed, all of the various embodiments of the invention that have been described and illustrated in FIGS. 1 through 13, are all built of common elements and have common principles of operation, namely breaking of pinned surface tension and self acceleration and self siphoning through a nozzle throat. They all offer the same advantages over the prior art that have been described and their operation is characterized by the following salient features:

1. A source flow of gas into the device, that depresses a confined liquid surface.

2. A sharp edge that captures and pins an interface between the gas and the confined liquid surface, namely a meniscus. This may take place either at the inlet of a nozzle tube, or at the rim of a conical nozzle.

3. The pinned meniscus becomes strained by the incoming flow of gas such that it eventually tears free allowing the gas to flow past the sharp edge and enter a nozzle tube, or flow around the rim edge into a conical nozzle.

4. The confined liquid surface rises upwards as the gas flows out eventually pinching off the flow of gas into the nozzle tube, or into the conical nozzle. This is the mechanism (intermittent breaking of surface tension) by which the various embodiments produce an intermittent pulse flow of short duration, one of the two essential features needed for vortex ring bubble formation.

5. For the case of the nozzle tube, the gas rises up through the tube, at a self accelerating, or an exponentially growing rate, thereby developing the vorticity necessary for vortex ring formation at the exit of the nozzle tube.

6. Alternatively, for the case of the gas entering the conical nozzle (from around the rim of the nozzle or from a separate nozzle tube), the emerging bubble is collected and buoyantly directed to the nozzle throat where it undergoes the same kind of self acceleration followed by a self-siphoning action. As before, this acceleration imparts vorticity to the pulsed flow, providing the other of the two essential features needed for vortex ring bubble formation.

7. Each of the various embodiments use a self-siphoning action to purge any remaining gas out of the nozzle tube, or out of the nozzle throat, and drive it into the developing ring.

8. The strength, thickness and size of the developing rings can be changed by appropriate changes to the sizes of the components of the embodiments, and once established, the embodiments will produce an endless succession of rings without human intervention, provided the source of bleed gas is maintained.

9. The frequency or rate at which the various embodiments produce ring bubbles can be changed by simply changing the pressure or flow rate of the source of gas.

10. Other embodiments that utilize the same principles of operation but which have still different geometry are possible. Indeed, many variations of the invention will now be obvious to those skilled in the art, and such obvious variations are within the scope of the invention as described and claimed, whether or not expressly described.

Figure 14:
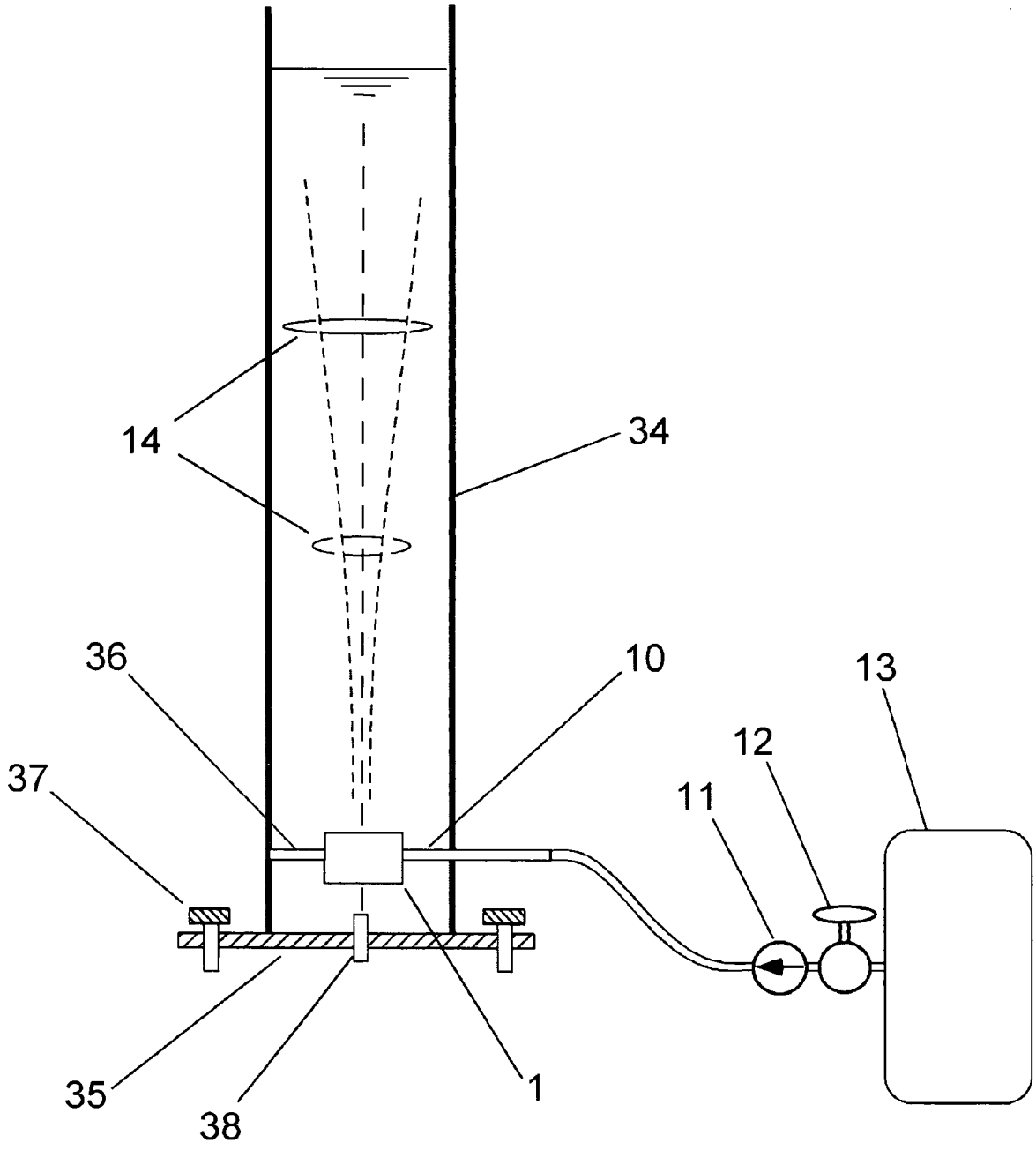
FIG. 14 depicts one possible application of the invention, called a Ring Lamp or Bubble Lamp, for producing rising vortex rings in a vertical tube, and which may be used for decorative purposes.

Because of its simplicity there are a variety of uses for this invention such as the following (although it need not be limited to these applications):

1. FIG. 14 depicts a decorative lamp, called a Ring Lamp or Bubble Lamp, using this invention. It consists of a transparent tube, 34, on a base, 35, with the invention mounted by a support strut, 36, in the center of the tube. The tube is filled with water as the host liquid, although other liquids can be used. Adjustment screws, 37 are provided to ensure that the tube is vertical. An illumination source, 38, which might be a light, such as a small laser, is positioned to shine up through the center of the nozzle, 2, of the invention, and up into the tube. The pressurized gas source, 13, may be a small pump such as commonly used to generate air bubbles in fish aquaria. In this application, the rings can be generated at some desired rate and will travel up the line of illumination from the source, 38, in a pleasing and engaging manner.

Figure 15:
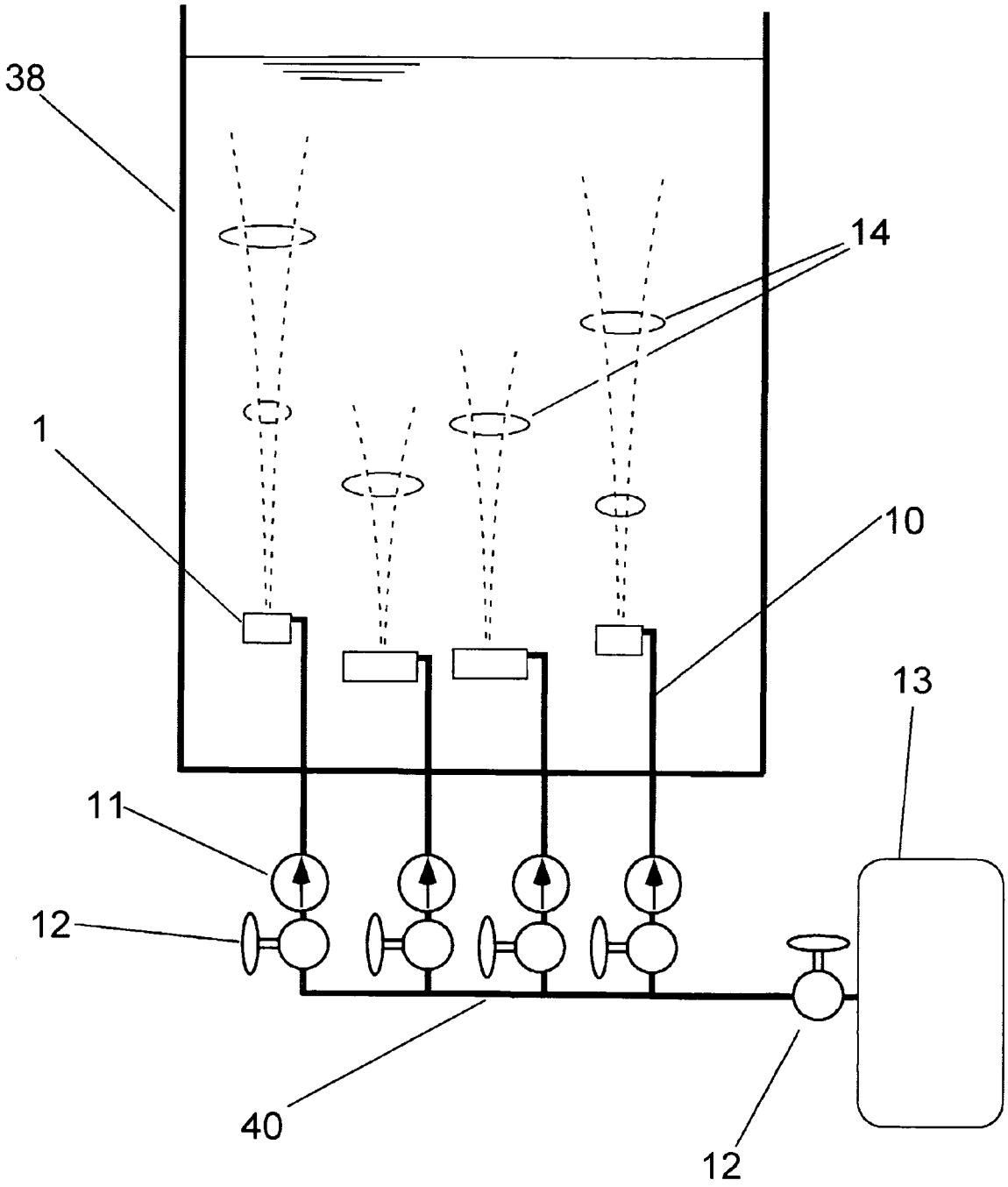
FIG. 15 depicts an alternative application of the invention in which a plurality of the devices is used to create unusual and visually captivating arrays of ring bubbles in a body of liquid.

2. FIG. 15 depicts a decorative application using an array of the devices in a tank, 39, filled with water, and whose walls may or may not be transparent. As before, a small pump may be used to provide air under pressure to a manifold, 40, that supplies the air, through control valves, 12, and check valves, 11, to the various ring generators, 1, submerged in the tank. These can be of different sizes to produce rings of different sizes, and may be positioned at different elevations within the tank. In addition, the various valves, 12, can be independently adjusted and set, so that each ring generator produces rings at different frequencies.

The result is and array of evolving rings that rise upwards and grow and interact in an engaging and captivating way.

3. Single devices, or multiple arrays of devices such as in FIG. 15, can be used as a decorative feature in swimming pools, decorative pools, ponds, jacuzzis, aquaria, or fountains.

4. Single devices or multiple arrays of devices can be used as the basis for toys for children to use in pools or bathtubs.

5. Single devices or multiple arrays of devices can be used for special effects in the cinema, film making or commercial television.

6. Single devices or multiple arrays of devices can be used as devices for advertising either in commercial film and video.

7. The device, or arrays of devices, can be used in commercial establishments to advertise products such as beverages.

8. If the gas used is a combustible mixture, then with an additional ignition source, unusual underwater circular explosions and flames can be produced which have value as special effect features for cinematography.

9. The flow field of the vortex ring is repeatable and can be used to calibrate scientific instruments that are used to measure fluid flows such as laser velocimeters, particle imaging velocimeters and hot-wire anemometers.

10. If the swirl of the vortex ring is measured by such instruments, then the coefficient of surface tension of the liquid, $\sigma$, can be determined. Thus, the device can be used as a tool to infer this important physical property of liquids.

11. Because the vortex rings are highly repeatable, with a repeatable surrounding flow field, then when generated in arrays from multiple sources, they give rise unusual vortex interactions which are an object of scientific study in their own right.

12. The invention may be used as a demonstration device to instruct and educate students in the behavior of ring vortices and surface tension phenomena.

What I claim as my invention is:

1. An apparatus, free of complex mechanisms or moving parts, for providing a simple means of generating vortex ring bubbles of a gas in a liquid medium, comprising:

an inverted cup immersed in a host liquid, said cup having a closed top end, side walls, and an open bottom end, so as to confine any gas within the confined gas volume of the inverted cup between said top and bottom ends, a single hollow nozzle tube protruding vertically through the center of the closed top end of the inverted cup, said nozzle tube having upper and lower ends, its lower open end positioned within the inverted cup and above the open bottom end of the inverted cup, and said upper and lower ends of the nozzle tube being symmetric and free of chips and burrs, and a feed port in fluid communication with the confined gas volume of the inverted cup and being connected to an external source of pressurized gas to allow pressurization of the gas in the confined volume of the inverted cup, and the internal wetted surfaces of the inverted cup and the nozzle tube are roughened or grooved to enhance wetting by the host liquid.

2. A method of producing gas-filled, vortex ring bubbles in the host liquid using the apparatus of claim 1 by applying a steady, controlled and slow flow of gas from the external pressurized source through the feed port causing:

a smooth liquid surface to form below the incoming gas in the confined volume of the inverted cup, surrounding the nozzle tube, with the incoming gas flow and rising pressure depressing said surface downwards, and thereby causing the level of this liquid surface to fall below the plane of the lower end of the nozzle tube, resulting in a momentary meniscus or liquid bridge spanning from the liquid surface up to the lower end of the nozzle tube, and the rising pressure causing this bridge to break, and to expose the confined volume of gas to the liquid inside the nozzle tube which momentarily remains pinned by surface tension as a mieniscus inside the lower end of the nozzle tube, and continuing to raise the pressure further in the confined volume, the gas pressure overcomes, or breaks the surface tension meniscus, at which time the confined gas is driven to flow as a contiguous, coherent and unbroken bubble, into the lower end of the nozzle tube and up through the nozzle tube, where it undergoes a unique process of self acceleration to emerge as a bubble at the nozzle tube upper end with enhanced energy, imparted from a buoyant self-acceleration mechanism, and the outflow of gas through the nozzle tube causes the liquid level in the confined volume to rise back up above the level of the lower end of the nozzle tube thereby flowing liquid into the lower end of the nozzle tube closing off any additional flow of gas from the confined volume into the nozzle tube and creating, as the liquid subsequently rushes up through the nozzle tube, a self-siphoning action that purges any remaining gas from the nozzle tube such that said emergent flow of gas is consequently fast and of short duration forming a vortex ring bubble.

3. An embodiment of the device of claim 1, for the cases when the nozzle tube is comparable to or smaller than the radius of curvature of the surface tension meniscus of the host liquid, in which a circular end plate is attached to either the upper or lower open end of the nozzle tube, said end plates extending from the outer circumference of the nozzle tube radially outward from the nozzle tube and terminating at a point spaced radially inward from the sidewall of the inverted cup.

4. An embodiment of the device of claim 1, in which a second inverted conical collector nozzle, sized larger than the inverted cup/nozzle tube combination, and with a second nozzle tube, is placed above the original nozzle tube and offset to one side of the original nozzle tube.

5. An embodiment of the device of claim 1, in which a cone or convergent shaped collector is placed on the inlet of the nozzle tube and in which the inverted cup fully surrounding the periphery of this cane inlet is reduced to a partial angular sector of said cup such that it only partially surrounds part of the periphery of the cone inlet, with side fences to maintain the confined gas volume.

6. The method of claim 2 in which the size of the vortex rings that is formed is increased by increasing the diameter of the inverted cup and increasing the diameter of the nozzle tube.

7. The method of claim 2 in which the size of the vortex rings that is formed is decreased by decreasing the diameter of the inverted cup and decreasing the diameter of the nozzle tube.

8. The method of claim 2 in which the flow rate or pressure of the incoming flow of gas from the pressurized source into the feed port is increased to increase the rate, or frequency at which vortex ring generation occurs.

9. The method of claim 2 in which the flow rate or pressure of the incoming flow of gas from the pressurized source into the feed port is decreased to decrease the rate, or frequency at which vortex ring generation occurs.

* * * * *